US006739990B2

(12) United States Patent
Lee

(10) Patent No.: US 6,739,990 B2
(45) Date of Patent: May 25, 2004

(54) GRIP FOR CATCHING A BALL

(75) Inventor: Woon Lee, Bucheon (KR)

(73) Assignee: Seung-Man Park, Kyungki-Do (KR)

( * ) Notice: Subject to any disclaimer, the term of this patent is extended or adjusted under 35 U.S.C. 154(b) by 0 days.

(21) Appl. No.: 10/204,671

(22) PCT Filed: Feb. 26, 2001

(86) PCT No.: PCT/KR01/00292

§ 371 (c)(1),
(2), (4) Date: Sep. 17, 2002

(87) PCT Pub. No.: WO01/62355

PCT Pub. Date: Aug. 30, 2001

(65) Prior Publication Data

US 2003/0078118 A1 Apr. 24, 2003

(30) Foreign Application Priority Data

Feb. 26, 2000 (KR) ..... 2000/5369 U

(51) Int. Cl.[7] ..... A63B 59/00; A63B 65/12
(52) U.S. Cl. ..... 473/510
(58) Field of Search ..... 473/510, 505, 473/512, 514, 517; 482/50; 124/5; 273/127 R, 127 B, 129 P, 129 R, 129 K, FOR 211

(56) References Cited

U.S. PATENT DOCUMENTS 3,953,030 A * 4/1976 Muchnick ..... 273/348.4
4,905,988 A * 3/1990 Mooneyhan ..... 482/50
5,209,490 A 5/1993 Dallavecchia
5,232,226 A * 8/1993 Glickson ..... 473/510
5,253,874 A * 10/1993 Hoffman ..... 473/514
2003/0078118 A1 * 4/2003 Lee ..... 473/510

FOREIGN PATENT DOCUMENTS

| | | |
|---|---|---|
| JP | 50-67973 | 6/1975 |
| KR | 20-1987-0012884 | 9/1987 |
| KR | 2000-0006106 | 4/2000 |
| KR | 2000-0016065 | 8/2000 |

* cited by examiner

*Primary Examiner*—Gregory Vidovich
*Assistant Examiner*—M. Chambers
(74) *Attorney, Agent, or Firm*—Birch, Stewart, Kolasch & Birch, LLP

(57) ABSTRACT

A grip for catching a ball easily catches a rubber ball or a basket ball with a smooth surface as well as catching a rough ball with fluff. The ball-catching grip includes a frame formed long in a vertical direction; a handle formed back side of the frame so as to be gripped by a user; a pair of ball-catching pockets rotatably combined at the front side of the frame, for being rotated to put together from an unfolded state in both directions to catch a ball; a pocket interworking unit provided between the pair of ball-catching pockets so that one ball catching pocket is rotated, the other ball-catching pocket is simultaneously rotated; an operating unit installed at the front side of the frame for maintaining unfolded state of the ball-catching pocket, and at the same time, releasing the unfolding state of the ball-catching pocket when a thrown ball collides therein; an elastic unit formed between the frame and the ball-catching pocket for providing an elasticity in the direction that the pair of ball-catching pockets put together. When a user pulls to unfold one ball-catching pocket with one hand while catching the handle with another hand, the other ball-catching pocket is simultaneously unfolded. Thus, the user can easily unfold the both ball-catching pockets simultaneously, and even children can easily use it.

20 Claims, 9 Drawing Sheets

GRIP FOR CATCHING A BALL

TECHNICAL FIELD

The present invention relates to a grip for catching a ball, and particularly, to a grip for catching a ball which is able to catch a rubber ball having smooth surface and a baseball as well as a nappy ball.

BACKGROUND ART

Generally, a catch ball is a game tool by which people of two or more catch a ball thrown by the other people with a certain distance in a playground or in an empty space.

The catch ball is generally known as an adhesive catch ball which has an adhesive drapery on a front part of a catching plate having a handle so that a nappy ball such as a tennis ball.

The catch ball described as above, however, cannot catch a ball having smooth surface such as a rubber ball and a baseball. In addition, if the adhesive drapery is worn, even the nappy ball is not stuck strongly, whereby the life span of catch ball is shortened and interest for the catch ball is lost.

Accordingly, the present applicant designed a covering ball type grip for catching a ball and filed on Sep. 9, 1998 (utility model application number 1998-17122, referred to as 'first application') and on Jan. 23, 1999 (utility model application number 1999-00878, referred to as 'second application') in Korea Industrial Property Office (KIPO), in addition, the first application is issued as utility model No. 205076 on Sep. 20, 2000.

However, the design of the 'first application' is constructed such that the operation lever for opening ball-catching pocket is installed inside the handle and the user is able to open the pocket by pulling the operation lever with the handle. Therefore it has the advantage that the ball is able to caught using one hand, but the user needs much power in order to open the pocket.

In addition, the design of the 'second application' is constructed such that a separate pulling member is coupled to the ball-catching pocket, and the user holds the handle with one hand and pulls the pulling member with the other hand, whereby the ball-catching pocket is opened. Therefore, it is somewhat inconvenient because the user should use both hands in order to open the ball-catching pocket.

TECHNICAL GIST OF THE PESENT INVENTION

Therefore, an object of the present invention is to provide a grip for catching a ball having both ball-catching pockets which are opened easily by holding the handle with one hand and pulling one ball-catching pocket by the other hand, and preventing the ball from rushing out of the ball-catching pocket when the user catches the ball, whereby the reliability of the operation is able to be increased.

DETAILED DESCRIPTION OF THE INVENTION

In order to achieve the above objects, there is provided a grip for catching a ball including : a frame formed long in a vertical direction; a handle formed on a rear side of the frame so that a user is able to grip; a pair of ball-catching pockets rotatably combined at a front side of the frame, for being rotated to put together from an unfolded state in both directions to catch a ball; a pocket interworking unit provided between the ball-catching pockets so that if one pocket is rotated, the other pocket is simultaneously rotated; an operating unit installed at the front side of the frame for maintaining unfolded state of the pockets, and at the same time, releasing the unfolded state of the pockets when a ball collides therein; and an elastic means disposed between the frame and the ball-catching pockets for providing elasticity in the direction that the pair of ball-catching pockets put together.

Also, In order to achieve the above objects, there is provided a grip for catching a ball including: a frame formed long in a vertical direction; a handle formed on a rear side of the frame so that a user is able to grip; a pair of ball-catching pockets rotatably combined at the front side of the frame, for being rotated to put together from an unfolded state in both directions to catch a ball; a pocket interworking unit provided between the ball-catching pockets so that if one pocket is rotated, the other pocket is simultaneously rotated; an operating unit installed at the front side of the frame for maintaining unfolded state of the pockets, and at the same time, releasing the unfolded state of the pockets when a ball collides therein, wherein a slopped part is included so that the ball is bound inward of the ball-catching pockets when the ball is bumped; and an elastic means disposed between the frame and the ball-catching pockets for providing elasticity in the direction that the pair of ball-catching pockets put together.

MODE FOR CARRYING OUT THE PREFERRED EMBODIMENTS

The present invention will now be described with reference to accompanying drawings.

Figure 1:
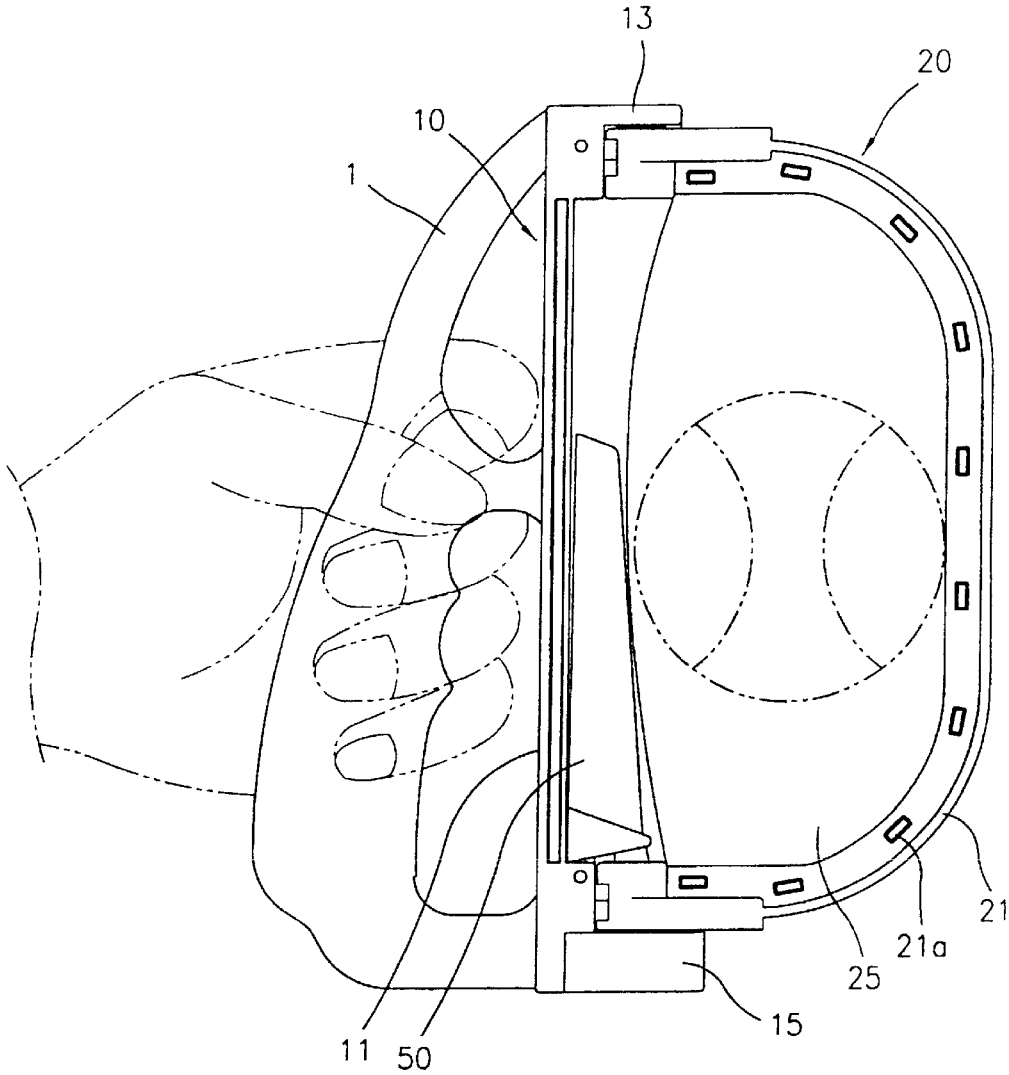
FIG. 1 is a side view showing an external form of the grip for catching a ball according to the present invention.
Figure 2:
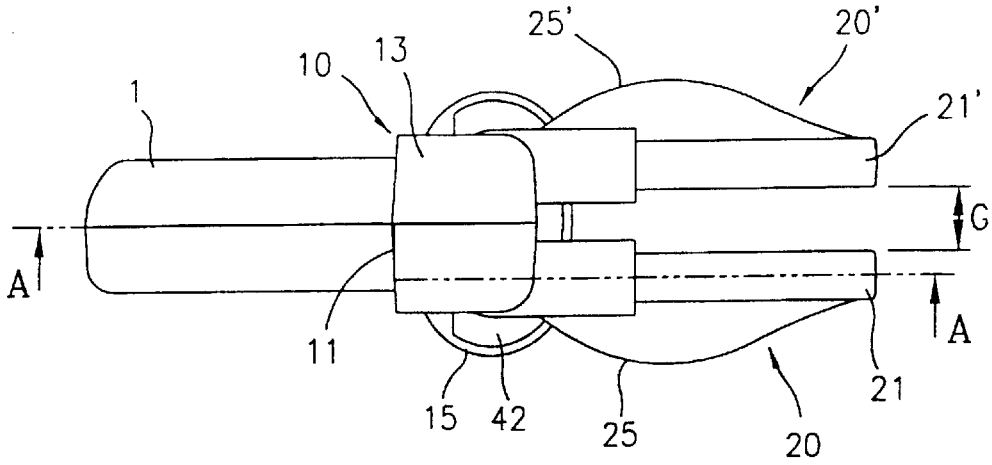
FIG. 2 is a plan view showing the external form of the grip for catching a ball according to the present invention.

FIG. 1 is a side view showing the external view of the grip for catching a ball according to the present invention, and FIG. 2 is a plan view showing the external view of the grip for catching a ball according to the present invention.

As shown in FIGS. 1 and 2, the grip for catching a ball according to the present invention includes a frame 10, on which a handle 1 is formed, formed long in a vertical direction, and a pair of ball-catching pockets 20 and 20' are installed on a front side of the ball-catching pockets so that a thrown ball can be caught by putting together from the unfolded state.

Also, on the front side of the frame 10 between the pair of ball-catching pockets 20 and 20', an operation plate 50 releasing the unfolded state is disposed so that if a ball is bumped therein, the ball-catching pockets 20 and 20' are closed putting together.

The handle 1 is formed as 'E' so that the user is able to grip it easily and is formed on the rear side of the frame 10 as a single body with the frame.

In the frame, a supporting board 11 is formed long in a vertical direction, a handle 1 is formed on a rear side of the supporting board 11, and the operation plate 50 is disposed on the front side of the supporting board 11. In addition, supporting parts 13 and 15 are formed protrusive from upper and lower parts of the supporting board 11 so as to support the pair of ball-catching pockets 20 and 20' rotatably.

The pair of ball-catching pockets 20 and 20' includes a pair of pocket frames 21 and 21', and both end parts of the pocket frames 21 and 21' are coupled between the upper supporting part 13 and the lower supporting part 15 of the frame 10 so as to be rotational. In addition, pocket members 25 and 25' for preventing the caught ball from falling out of the pockets are installed in the respective pocket frames 21 and 21'.

The pocket members 25 and 25' are installed on a plurality of fixing holes 21 a successively formed on one side of the pocket frames 21 and 21' using a string, etc.

Herein, it is desirable that the pocket frames 21 and 21' are formed by hardened plastic material same as the handle 1, frame 10, and the operation plate 50. In addition, it is desirable that the pocket member 25 is made by a leather material so as to maintaining the ball-catching state and performing buffing operation.

The pair of ball-catching pockets 20 and 20' including the pocket frames 21 and 21' and the pocket members 25 and 25' is constructed such that a certain distance G is maintained in the closed state so that the user is able to open the pockets by pulling one of the pockets, as shown in FIG. 2.

In addition, the internal structure of the grip for catching a ball according to the present invention will be described with reference to FIGS. 3 and 4.

Figure 3:
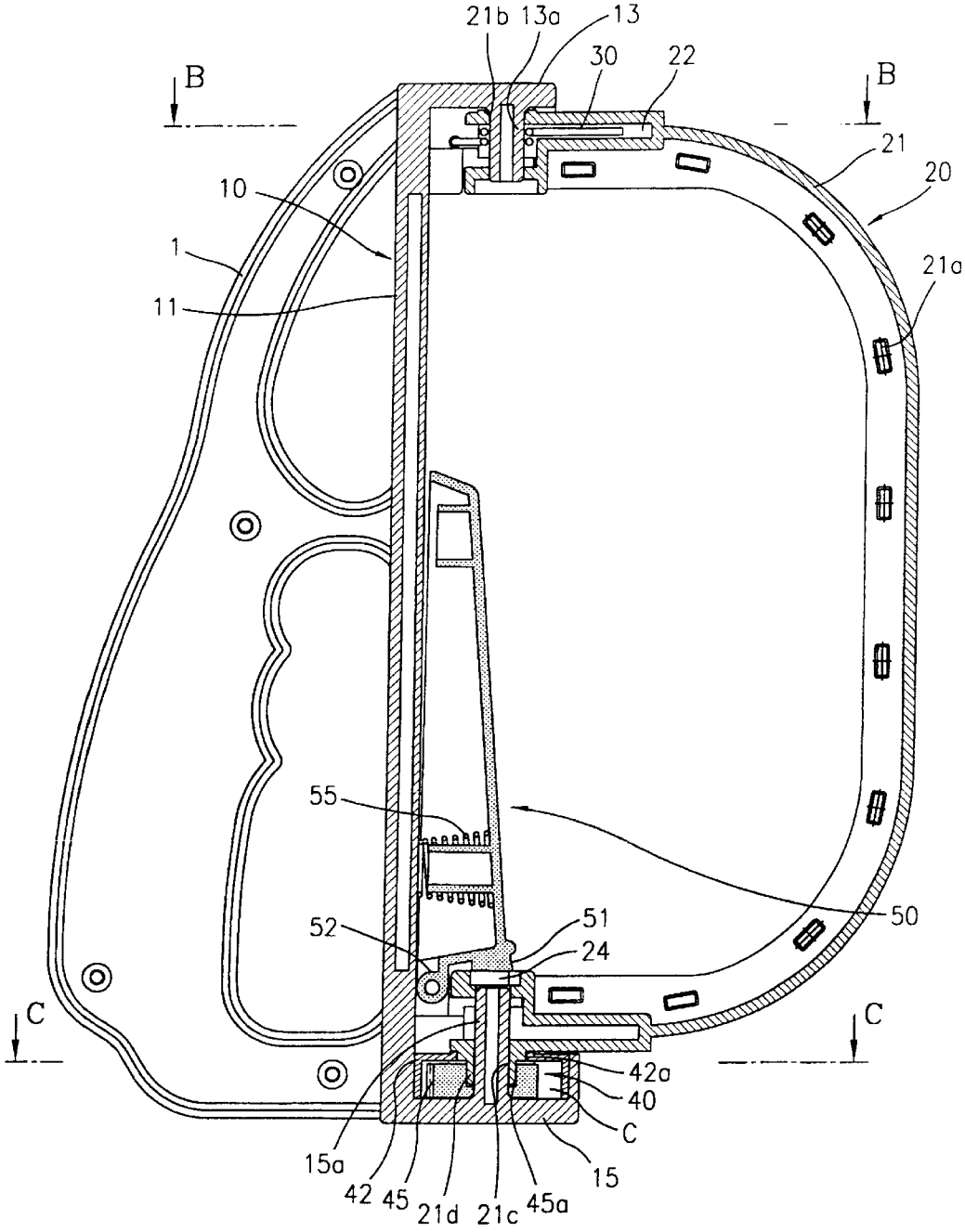
FIG. 3 is a cross-sectional view of line A—A of FIG. 2.
Figure 4A:
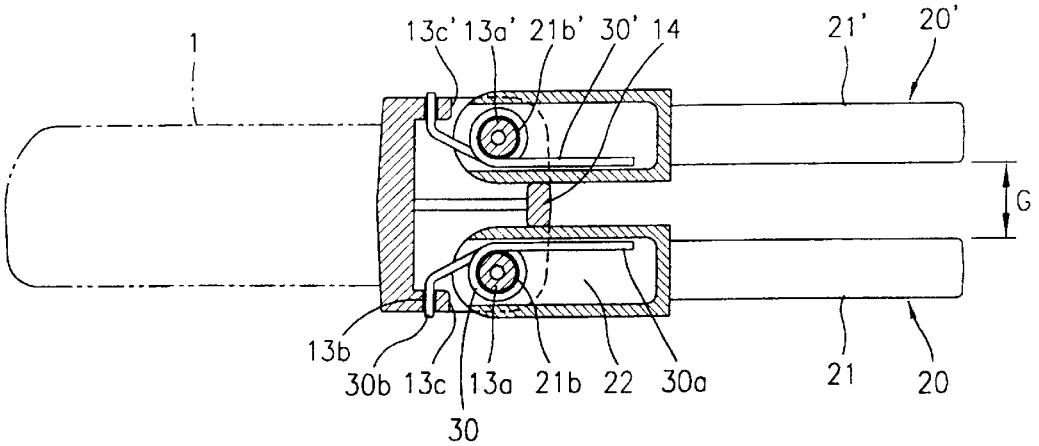
FIG. 4A is a cross-sectional view of line B—B of FIG. 3.
Figure 4B:
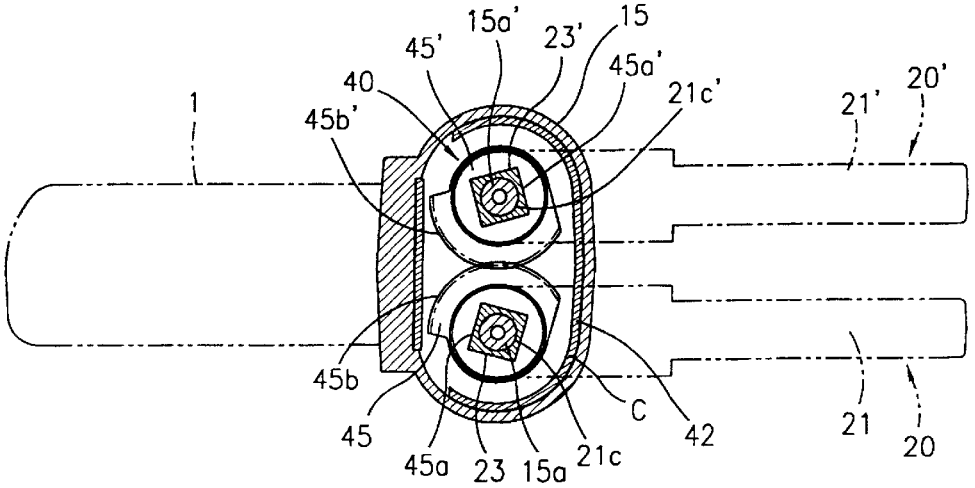
FIG. 4B is a cross-sectional view of line C—C of FIG. 3.

FIG. 3 is a cross-sectional view of line A—A of FIG. 2 and showing the grip for catching a ball according to the present invention. FIG. 4A is a cross-sectional view of line B—B in FIG. 2, and FIG. 4B is a cross-sectional view of line C—C in FIG. 3.

With reference to FIGS. 3 and 4, a pair of hinge rods 13*a*, 13*a'*, 15*a*, and 15*a'* are formed protrusive from the upper supporting part 13 and from the lower supporting part 15 respectively, so that the pair of ball-catching pockets are able to be coupled rotatably. In addition, in the pair of ball-catching pockets, hinge holes 21*b*, 21*b'*, 21*c*, and 21*c'* are formed on upper part and on lower part of the pocket frames 21 and 21' so that the hinge rods is inserted therein.

Also, pocket springs 30 and 30' supplying elastic force to the direction of putting together of the ball-catching pockets, that is, the direction of catching the ball are installed on the upper supporting part 13 of the frame 10.

As shown in FIGS. 3 and 4A, the pocket springs 30 and 30' is formed as a general coil spring and is installed on boundary of the hinge rods 13*a* and 13*a'*. In addition, its one end 30*a* is supported by being inserted into the ball-catching pocket 20, and the other end 30*b* is supported by being inserted into the frame 10, whereby the elastic force is supplied to the direction of putting together the pair of ball-catching pockets 20 and 20'.

Herein, a spring insertion recess unit 22 is formed on the ball-catching pocket 20, and a spring insertion hole 13*b* is formed on the frame 10.

Even if the pocket springs 30 and 30' are installed on only one ball-catching pocket 20 between the two pockets 20 and 20', the pocket springs 30 and 30' are able to supply the elastic force to the other ball-catching pocket 20' through a pocket interworking unit 40 which will be described later.

Also, a protrusion for maintaining distance 14 is formed on a center part of the upper supporting part 13 in the frame 10 so that a certain distance G between the two ball-catching pockets 20 and 20' in the state that the pockets put together, as shown in FIG. 4. And stopper surfaces 13*c* and 13*c'* for restricting the opening of the ball-catching pockets 20 and 20' are formed on both sides of the upper supporting part 13.

The protrusion for maintaining distance 14 maintains a certain distance G between front parts of the pocket frames 21 and 21' in the state that the ball-catching pockets 20 and 20' are closed, whereby the user is able to open the ball-catching pockets easily by pulling one ball-catching pocket.

In addition, a pocket interworking unit 40 by which when one ball-catching pocket between the ball-catching pockets 20 and 20' is rotated, then the other pocket is simultaneously rotated is installed on the lower supporting part 15 of the frame 10, as shown in FIGS. 3 and 4B.

That is, an interworking space C is formed on the lower supporting part of the frame so that the pocket interworking unit 40 is able to be installed, and an interworking cover 42 is covered on upper part of the interworking space C.

A pair of hinge rods 15*a* and 15*a'* formed on the frame 10 are formed protrusive on the interworking space, and two holes 42*a* through which the hinge rods 15*a* and 15*a'* penetrate are formed on the interworking cover 42.

Especially, gear coupling unit 23 and 23' formed by extending the boundary part of the hinge holes 21*c* and 21*c'* to the inside of the interworking space C through a hole 42*a* of the interworking cover 42 are formed on the pair of ball-catching pockets 20 and 20', and a pair of interworking gears 45 and 45' forming interworking operation force by meshing with each other are installed on the respective gear coupling units 23 and 23'.

Herein, the gear coupling units 23 and 23' and the interworking gears 45 and 45' are constructed as a coupling structure constraining each other to the rotating direction, for example, the gear coupling units 23 and 23' is formed as a square, and the interworking gears 45 and 45' have square holes 45*a* and 45*a'*, and thereby these are coupled with each other.

In addition, it is desirable that the pair of interworking gears 45 and 45' is formed as a fan-shape so that gear teeth 45*b* and 45*b'* have a meshed structure in the rotation range of the ball-catching pockets 20 and 20'.

Figure 5:
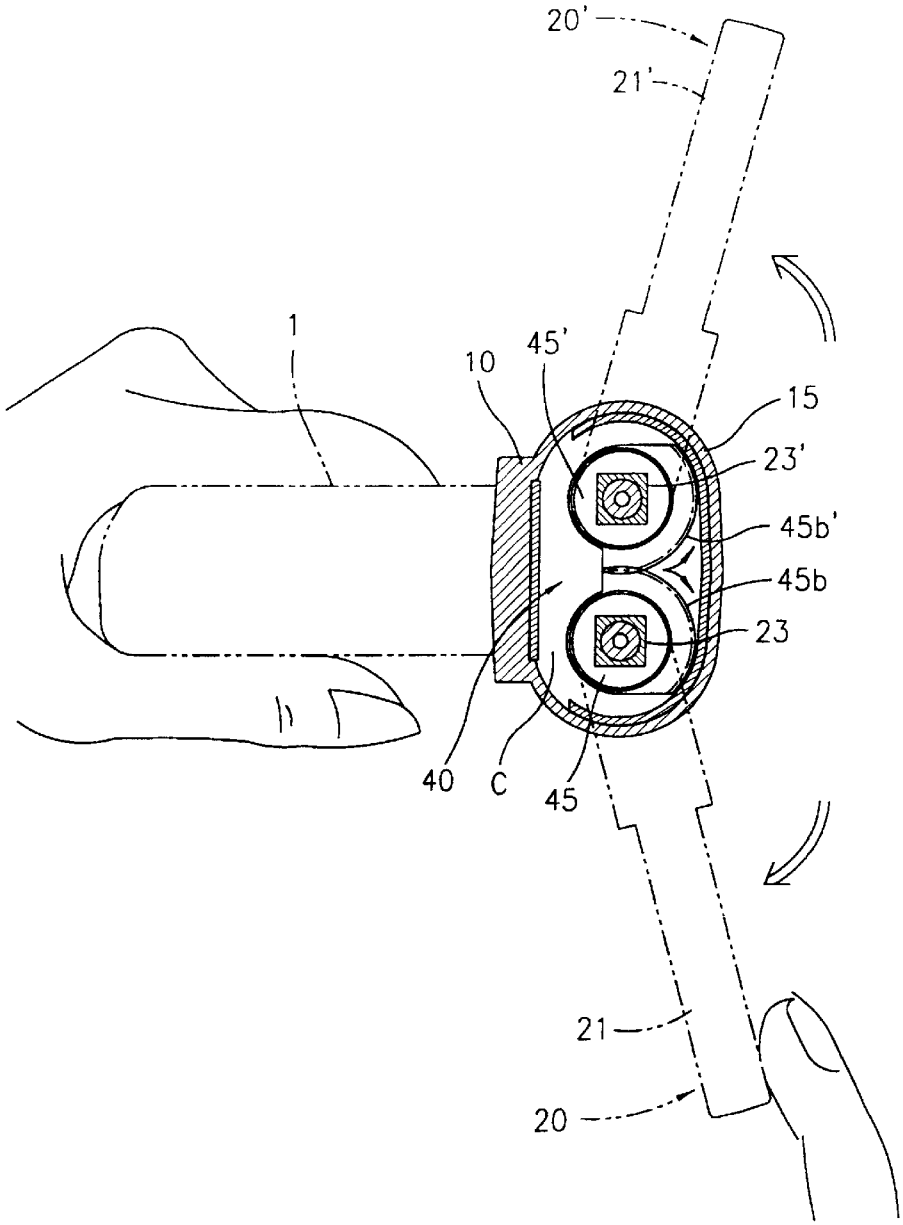
FIG. 5 is a transverse cross-sectional view showing an operating state of the pocket interworking unit when the ball-catching pockets are unfolded.

FIG. 5 is a transverse cross-sectional view showing operation state of the pocket interworking unit when the ball-catching pockets are unfolded. As shown therein, the pair of interworking gears 45 and 45' rotate simultaneously with the ball-catching pockets 20 and 20', coupled by the fear coupling units 23 and 23'. Thereby, when a user rotates one ball-catching pocket 20, then the other ball-catching pocket 20' is rotated to the opposite direction by the pair of interworking gears 45 and 45'. Then the pair of ball-catching pockets 20 and 20' are unfolded to both direction so that the user is able to catch the ball easily.

Figure 6A:
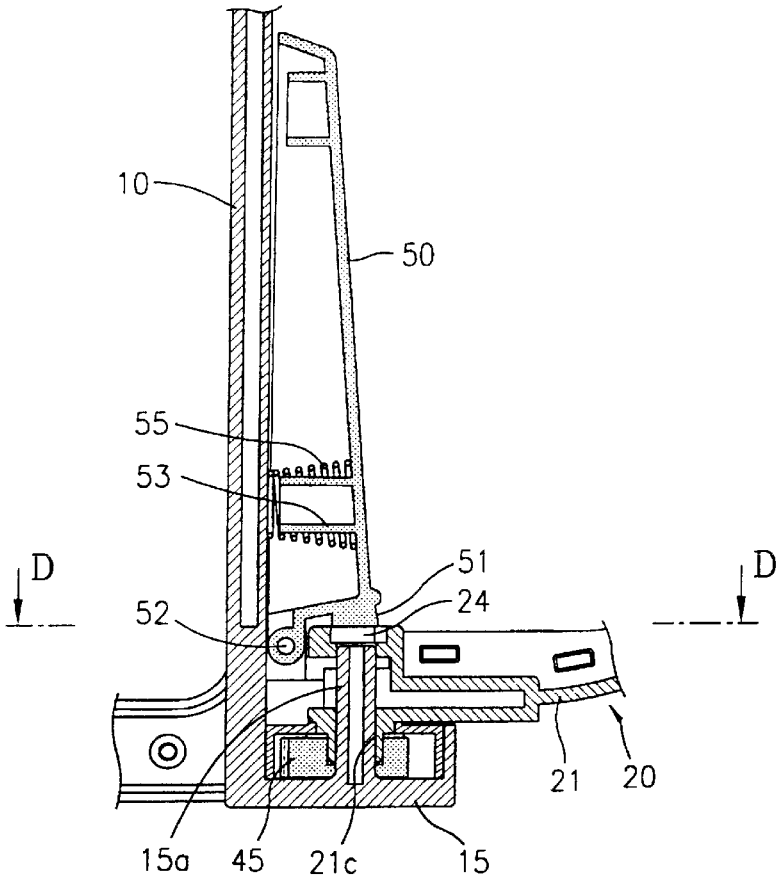
FIG. 6A is a longitudinal sectional view showing a coupled state of a operating plate and the ball-catching pocket when the ball-catching pockets are closed.
Figure 6B:
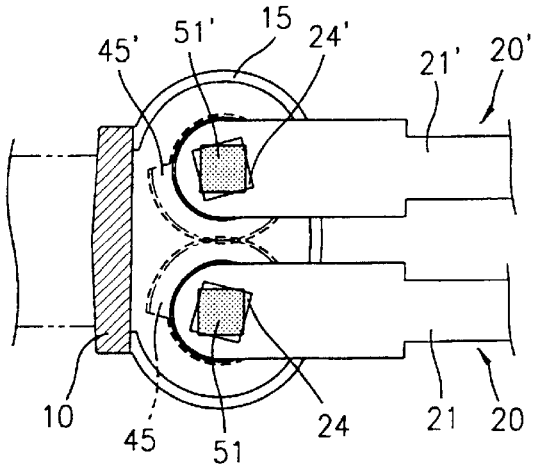
FIG. 6B is a cross-sectional view line D—D of FIG. 6A.
Figure 7A:
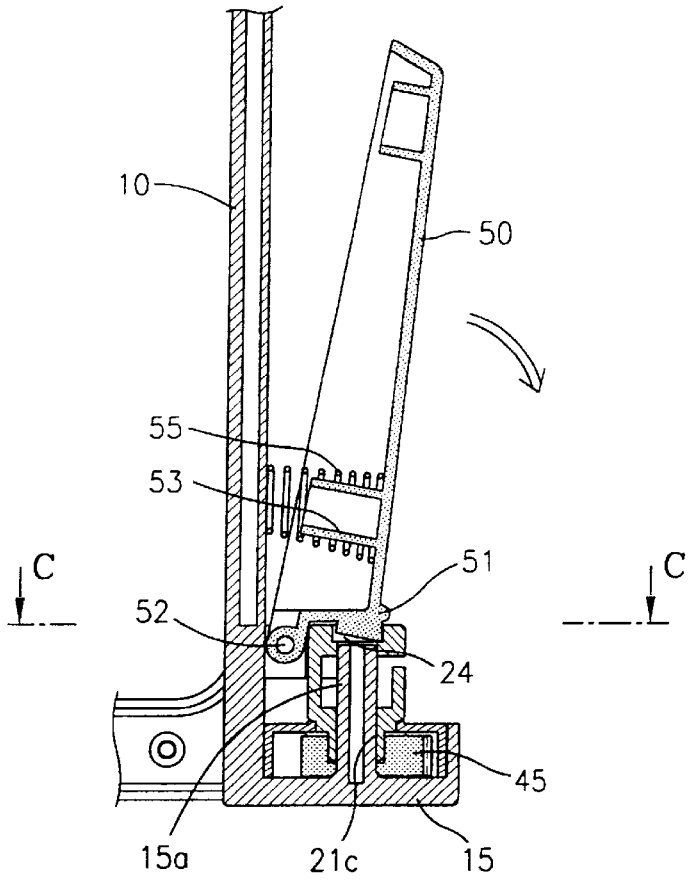
FIG. 7A is a longitudinal sectional view showing a coupled state of the operating plate and the ball-catching pockets when the ball-catching pockets are opened.
Figure 7B:
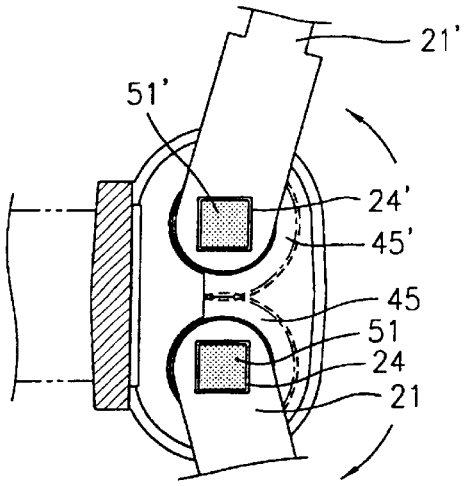
FIG. 7B is a cross-sectional view of line E—E of FIG. 7A.

And, FIGS. 6 and 7 are showing the operation structure of the operation plate according to the present invention. FIG. 6A is a longitudinal sectional view showing the coupled state of the operation plate and the ball-catching pockets when the ball-catching pockets are closed, and FIG. 6B is a cross-sectional view of line D—D in FIG. 6A. Also, FIG. 7A is a longitudinal sectional view showing the coupled state of the operation plate and the ball-catching pockets when the ball-catching pockets are unfolded, and FIG. 7B is a cross-sectional view of line E—E in FIG. 7A.

The operation plate 50 maintains the unfolded state of the ball-catching pockets 20 and 20' in front of the frame 10, and at the same time, has a function of releasing the unfolded state of the ball-catching pockets 20 and 20' when a thrown ball is bumped therein.

That is, lower back part of the operation plate 50 is connected to the frame 10 by a hinge groove 52 and is stood in vertical direction along with the frame 10 so as to be rotated frontward/backward directions. And a pair of restriction protrusions 51 and 51' are formed on front lower part of the operation plate 50 in order to restrict the rotation of the ball-catching pockets 20 and 20' to the direction of closing by the pocket springs 30 and 30', when the pair of the ball-catching pockets 20 and 20' are unfolded.

In addition, on the ball-catching pockets 20 and 20', protrusion insertion recesses 24 and 24' are formed on upper part of the hinge holes 21*c* and 21*c*' corresponding to the restriction protrusions 51 and 51'.

The restriction protrusions 51 and 51' and the protrusion insertion recesses 24 and 24' are formed as square shape so that the restriction protrusions 51 and 51' are inserted into the protrusion insertion recesses 24 and 24', whereby the rotation of the ball-catching pockets is restricted only in the state that the ball-catching pockets 20 and 20' are totally unfolded, as shown in FIGS. 6B and 7B.

That is, the restriction protrusions 51 and 51', and the corresponding 5 the protrusion insertion recesses 24 and 24' are formed as squared shape corresponding with each other, and embossed edges of the restriction protrusions 51 and 51' are hooked on the engraved edges of the protrusion insertion recesses 24 and 24', whereby the rotation of the pocket frames 21 and 21', that is, the rotation of the ball-catching pockets 20 and 20' is restricted.

In addition, an operation plate spring 55 for supplying the elastic force to the restriction protrusions 51 and 51' so that the protrusions 51 and 51' can be inserted into the protrusion insertion recesses 24 and 24' when the ball-catching pockets 20 and 20' are totally unfolded is installed between the operation plate 50 and the frame 10. And a spring fixing frame 53 in which the operation plate spring 55 is inserted and installed is formed on rear center part of the operation plate 50.

Therefore, as shown in FIG. 6, the restriction protrusions 51 and 51' are crossed with the protrusion insertion recesses 24 and 24' in the state that the ball-catching pockets 20 and 20' is closed, whereby the restriction protrusions 51 and 51' can not be inserted into the recesses 24 and 24'.

However, as shown in FIG. 7, when the ball-catching pockets 20 and 20' are unfolded, the restriction protrusions 51 and 51' of the operation plate 50 are accorded with the protrusion insertion recesses 24 and 24' and inserted into the protrusion insertion recesses 24 and 24'. At that time, the operation plate 50 is slanted frontward by the elastic force of the operation plate spring 55, then the restriction protrusions 51 and 51' are inserted into the protrusion insertion recesses 24 and 24', whereby the rotation of the ball-catching pockets 20 and 20' to the direction of closing is restricted.

In the above state, when the ball is bumped on the operation plate 50, the operation plate 50 rotates centering around the hinge groove 52 and then the restriction protrusions 51 and 51' are seceded from the protrusion insertion recesses 24 and 24'. At that time, the ball-catching pockets 20 and 20' are closed by the elastic force of the pocket springs 30 and 30', and are able to catch the ball.

Figure 8A:
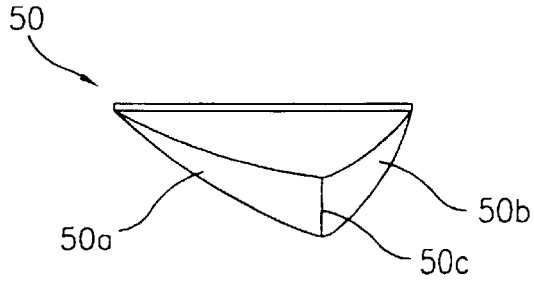
FIG. 8A is a plan view showing the operating plate of the grip for catching a ball according to the present invention.
Figure 8B:
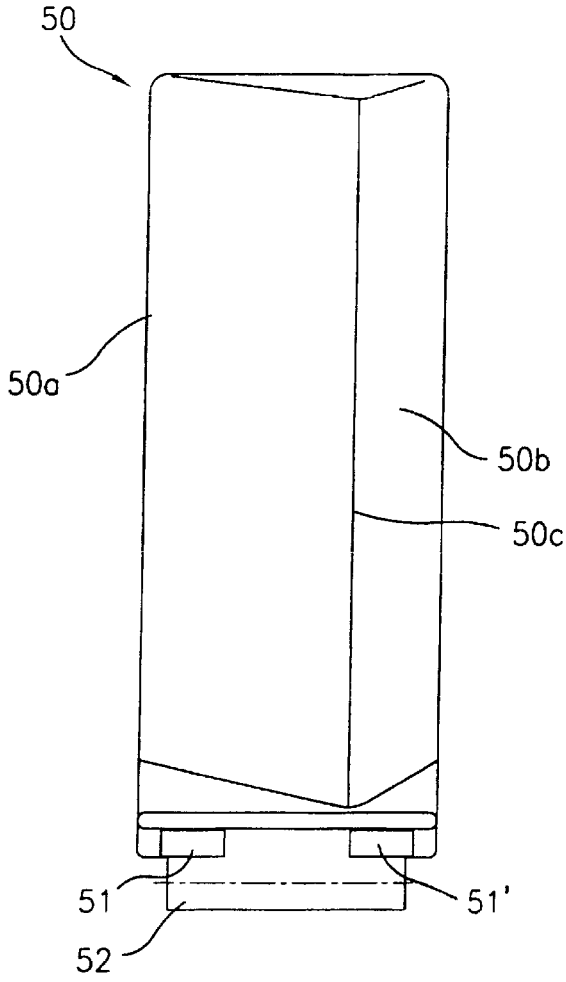
FIG. 8B is a front view showing the operation plate of the grip for catching a ball according to the present invention.
Figure 8C:
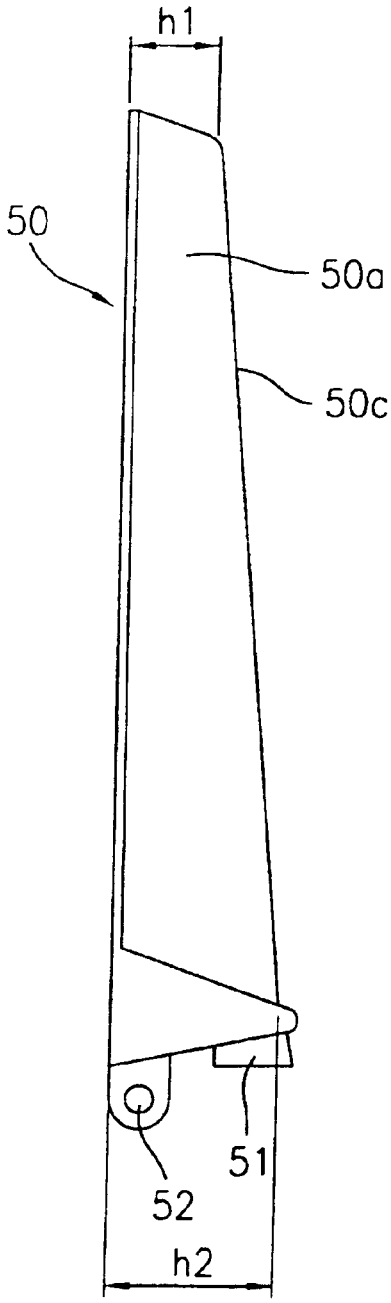
FIG. 8C is a side view showing the operation plate of the grip for catching a ball according to the present invention.

FIG. 8 is showing the operation plate of the grip for catching a ball according to the present invention. FIG. 8A is a plan view of the operation plate, FIG. 8B is a front view, and FIG. 8C is a side view.

The operation plate 50 according to the present invention has slopped surfaces 50*a* and 50*b* so that the ball is not bounded toward, but bounded inward of the ball-catching pockets 20 and 20'. And the slopped surfaces 50*a* and 50*b* are formed long in the vertical direction and are located facing the both ball-catching pockets 20 and 20' respectively.

In the operation plate 50 having the slopped surfaces 50*a* and 50*b*, a highest line 50*c* highest from the bottom surface of the operation plate 50 is located eccentric to one side, whereby one slopped surface 50*a* is formed to have larger area than the other slopped surface 50*b*. In addition, the slopped surfaces 50*a* and 50*b* are formed as convexed round shape.

Also, the operation plate 50 has the thickness of upper part h1 smaller than that of lower part h2 so that the operation plate is formed slopped to the upper direction, as shown in FIG. 8C.

As described above, the operation plate 50 has the highest line 50*c* eccentric to one side, and therefore the center part of the operation plate 50, where the ball is likely to bumped, is formed as a slopped surface 50*a*, whereby the bounces of the ball out of the ball-catching pockets 20 and 20' is able to be reduced. In addition, the thickness of the upper part h1 is formed smaller than that of the lower part h2, whereby the thrown ball describing parabola is easily caught.

The operation of the grip for catching a ball according to the present invention will be described as follows.

As shown in FIG. 5, when the user holds the handle1 with one hand and pulls the pocket frame 21 of the one ball-catching pocket 20 with the other hand, the interworking gear 45 coupled to the pocket frame 21 is rotated to one direction, then the other interworking gear 45' meshed with the interworking gear 45 is simultaneously rotated to the opposite direction.

At that time, the ball-catching pocket 20' including the other pocket frame 21' coupled to the other interworking gear 45' is rotated to the opposite direction of the rotation direction of the ball-catching pocket 20, whereby the two ball-catching pockets 20 and 20' are totally unfolded in a certain range while compressing the pocket springs 30 and 30' in FIG. 4A.

Herein, as shown in FIG. 7, the operation plate 50 located between the two ball-catching pockets 20 and 20' has a force to rotate frontward by the operation plate spring 55. And when the both pocket frames 21 and 21' are unfolded, the restriction protrusions 51 and 51' of the operation plate 50 are inserted into the protrusion insertion recesses 24 and 24' of the pocket frames 21 and 21', and then holds the pocket frames 21 and 21'. Thereby, the two ball-catching pockets 20 and 20' are totally unfolded.

After that, when a ball thrown by the other person is bumped on the operation plate 50 between the ball-catching pockets 20 and 20' in the state that the user is holding the handle 1, the operation plate 50 is rotated by being pushed to backward centering around the hinge groove 52 while compressing the operation plate spring 55. At that time, the restriction protrusions 51 and 5' of the operation plate 50 are seceded from the protrusion insertion recesses 24 and 24' of the respective pocket frames 21 and 21', and accordingly, the ball-catching pockets 20 and 20' are put together by the restoring force of the pocket springs 30 and 30', whereby the ball is able to be caught.

INDUSTRIAL APPLICABILITY

As so far described, according to the handle for catching a ball of the present invention is ball-catching type, that is, covering entirely the ball as in pre-patented grips for catch ball, whereby the grip according to the present invention is able to catch a ball having smooth surfaces such as a rubber ball and base ball, as well as the nappy ball such as a tennis ball.

Especially, in the grip for catching a ball according to the present invention, both ball-catching pockets are connected through the interworking gear, and rotated together. Therefore, when the user holds the handle with one hand and pulls one ball-catching pocket with the other hand, the other ball-catching pocket is simultaneously opened. Accordingly, the user is able to open the ball-catching pockets with a small power, and even a child can use it easily.

Also, according to the grip for catching a ball of the present invention, the front surface of the operation plate is formed to be slopped to both directions and the highest line is eccentric to one side, accordingly the ball is not likely to be bounded out of the ball-catching pockets, whereby the stability of the ball-catching operation is able to be increased.

What is claimed is:

1. A grip for catching a ball including:

a frame formed long in a vertical direction; a handle formed on a rear side of the frame so that a user is able to grip; a pair of ball-catching pockets rotatably combined at a front side of the frame, for being rotated to put together from an unfolded state in both directions to catch a ball; a pocket interworking unit provided between the ball-catching pockets so that if one pocket is rotated, the other pocket is simultaneously rotated; an operating unit installed at the front side of the frame for maintaining unfolded state of the pockets, and at the same time, releasing the unfolded state of the pockets when a ball collides therein, wherein a slopped part is included so that the ball is bound inward of the ball-catching pockets when the ball is bumped; and an elastic means disposed between the frame and the ball-catching pockets for providing elasticity in the direction that the pair of ball-catching pockets put together.

2. The grip according to claim 1, wherein the frame includes supporting parts protrusive from upper part and from lower part so as to support the pair of ball-catching pockets rotatably.

3. The grip according to claim 1, wherein a distance maintaining means for maintaining a certain distance between the both ball-catching pockets in the state that the ball-catching pockets are folded is installed on the frame.

4. The grip according to claim 1, wherein stoppers for restricting the opening of the ball-catching pockets more than a certain extent are formed on both sides of the frame.

5. The grip according to claim 1, wherein the handle is formed as 'E' and fixed on rear surface of the frame as a single body.

6. The grip according to claim 1, wherein the pair of ball-catching pockets includes a pair of pocket frames coupled to the frame so as to be rotatable, and pocket members installed inside of the pair of pocket frames for preventing the ball from falling out of the pockets.

7. The grip according to claim 6, wherein the pocket frames are made with a hardened plastic material, and the pocket members are made with a leather material so as to maintaining the ball-catching state and to performing buffing operation.

8. The grip according to claim 1, wherein the pocket interworking unit comprises a pair of gear members installed on the pair of ball-catching pockets respectively and meshed with each other.

9. The grip according to claim 8, wherein the pair of gear members are formed as a fan-shape so that the gear teeth are meshed with each other within the range of rotating of the ball-catching pockets.

10. The grip according to claim 8, wherein an interworking space is formed on lower part of the frame so that the pair of gear members are included, an interworking cover is covered the opened upper part of the interworking space, and holes are formed on the interworking cover so as to connect the gear member and the ball-catching pocket.

11. The grip according to claim 1, wherein the operating unit includes an operation plate connected to the frame using a hinge for maintaining and releasing the unfolded state of the pair of ball-catching pockets while rotating frontward/backward directions, and a elastic unit installed between the operation plate and the frame for providing the elastic force to the operation plate.

12. The grip according to claim 11, wherein the operation plate includes slopped surfaces so that the ball is not bounded out of the ball-catching pockets, but bounded inside of the ball-catching pockets.

13. The grip according to claim 12, wherein the slopped surfaces are formed on right/left sides toward the ball-catching pockets, and highest line is located to be eccentric to one side.

14. The grip according to claim 11, wherein a pair of restriction protrusions are formed on the operation plate, and a pair of protrusion insertion recesses are formed on the corresponding parts of the ball-catching pockets, then the restriction protrusions are inserted into the protrusion insertion recesses when the ball-catching pockets are unfolded.

15. The grip according to claim 14, wherein the restriction protrusions and the protrusion insertion recesses are formed as square.

16. The grip according to claim 11, wherein the operation plate has smaller thickness of upper part than that of lower part so that the front part of the operation plate is slopped upward.

17. The grip according to claim 1, wherein the elastic unit is installed only one ball-catching pocket and frame between the pair of ball-catching pockets.

18. A grip for catching a ball including:

a frame formed long in a vertical direction; a handle formed on a rear side of the frame so that a user is able to grip; a pair of ball-catching pockets rotatably combined at a front side of the frame, for being rotated to put together from an unfolded state in both directions to catch a ball; a pocket interworking unit provided between the ball-catching pockets so that if one pocket is rotated, the other pocket is simultaneously rotated; an operating unit installed at the front side of the frame for maintaining unfolded state of the pockets, and at the same time, releasing the unfolded state of the pockets when a ball collides therein, wherein a slopped part is included so that the ball is bound inward of the ball-catching pockets when the ball is bumped; an elastic means disposed between the frame and the ball-catching pockets for providing elasticity in the direction that the pair of ball-catching pockets put together; and the operating unit is formed to have slopped surfaces so that the ball is not bounded out of the ball-catching pockets, but bounded inside of the ball-catching pockets.

19. The grip according to claim 18, wherein the slopped surfaces of the operating unit are formed on right/left sides toward the ball-catching pockets, and highest part is located to be eccentric to one side.

20. The grip according to claim 18, wherein the operating unit has smaller thickness of upper part than that of lower part so that the front part of the operating unit is slopped upward.

* * * * *